US005707253A

United States Patent [19]

Matsumoto et al.

[11] Patent Number: 5,707,253

[45] Date of Patent: Jan. 13, 1998

[54] CONSTRUCTION FOR PREVENTING SHIFT OF SHEATH

[75] Inventors: Mitsuhiro Matsumoto; Hidehiko Kuboshima; Takayoshi Endo, all of Shizuoka, Japan

[73] Assignee: Yazaki Corporation, Tokyo, Japan

[21] Appl. No.: 613,196

[22] Filed: Mar. 8, 1996

[30] Foreign Application Priority Data

Mar. 10, 1995 [JP] Japan ..... 7-51388

[51] Int. Cl.[6] ..... H01R 9/03

[52] U.S. Cl. ..... 439/610; 439/99

[58] Field of Search ..... 439/607, 610, 439/92, 98, 99

[56] References Cited

U.S. PATENT DOCUMENTS 5,222,909 6/1993 Nomura et al. ..... 439/92
5,338,227 8/1994 Nakamura ..... 439/610 X
5,429,529 7/1995 Hashizawa et al. ..... 439/610

FOREIGN PATENT DOCUMENTS 4-259770 9/1992 Japan ..... H01R 13/648
4-135186 12/1992 Japan ..... H01R 25/00
5-23458 3/1993 Japan ..... H01R 13/648
5-57778 7/1993 Japan ..... H01R 13/648

*Primary Examiner*—Khiem Nguyen
*Attorney, Agent, or Firm*—Sughrue, Mion, Zinn, Macpeak & Seas, PLLC

[57] ABSTRACT

A contact element includes a clamped portion connected on a shielding net folded back on a sheath after being exposed by removing an end portion of the sheath of a shield wire, and a folded portion formed to extend the clamped portion, the folded portion being folded to an inside of the clamped portion, and inserted between the shielding net and an inner insulator so that the sheath and the shielding net are nipped by the clamped portion and the folded portion.

11 Claims, 3 Drawing Sheets

CONSTRUCTION FOR PREVENTING SHIFT OF SHEATH

BACKGROUND OF THE INVENTION

1. Field of the Invention

This invention relates to a construction for preventing a shift of a sheath at a connecting portion between a metal shell and shielding net of a shield connector.

2. Background

In a shield connector, a conductive cover (hereinafter, referred to a metal shell), for shielding an inner conductor from an outside electric field, and a shielding net (hereinafter, referred to a net) of a shield wire are electrically connected. FIG. 5 is a cross-sectional view illustrating the connection between the metal shell and the net. FIG. 6 is an enlarged view of a portion VI in FIG. 5.

A connector 1 includes a cylindrical outer housing 3 and a cylindrical inner housing 7 with a terminal receiving chamber 5 integrally formed within the outer housing 3. A shell insertion groove 11 for receiving a metal shell 9 is formed between the outer housing 3 and the inner housing 7.

On the other hand, a terminal 17 is connected to a conductor 15*a* of an insulated core 15 of a shield wire 13 by clamping. The terminal 17 has a flange portion 21 which is engaged with an elastic terminal retaining piece 19 formed within the terminal receiving chamber 5. An end portion of a sheath (outer insulating cover) 23 of the shield wire 13 is removed to expose an end portion of a net 25. The end portion of the net 25 is folded back on the sheath 23. On the folded portion of the net 25, a connecting portion 9*a* of the metal shell 9 is press-fitted to the net 25 by clamping in the direction of arrow a (see FIG. 6). Thus, the net 25 and the metal shell 9 are electrically connected to each other.

The terminal 17 connected to the shield wire 13 by clamping, is inserted into the terminal receiving chamber 5, thereby the flange portion 21 is engaged with the terminal retaining piece 19 to prevent a withdrawal of the terminal 17. At the same time, the metal shell 9 is inserted into the shell insertion groove 11. A rubber plug 27 is attached on the shielding wire 13 at a position rearwardly of the outer housing 3 for preventing water and dust from entering. The rubber plug 27 is held within the outer housing 3 by a rear holder 29.

Thus, the connector 1 of the above described construction can prevent an electro-magnetic wave fault by the metal shell 9, which is connected to the net 25, covering the inner housing 7 and shielding the inner conductor from the outer electric field.

However, in the conventional metal shell and net arrangement, since the connecting portion 9*a* of the metal shell 9 is press-fitted to the net 25 by clamping the connecting portion 9*a* from the outside thereof after covering the net 25, a force for clamping the connecting portion 9*a* is absorbed by a deformation of the sheath 23 or the insulated core 15, therefore, it has caused a failure of clamping. As a result, in particular, a shift of the sheath by a tension caused due to the wiring has occured. Further, the shielding performance is lowered by an insufficient contact between the metal shell 9 and the net 25 due to the shift of the sheath. On the other hand, in the conventional example, an adhesive is applied to the clamped portion for preventing the shift of the sheath, however, there is encountered a drawback that the efficiency of the operation is low.

SUMMARY OF THE INVENTION

The present invention has been made in view of the above problems, and an object of the invention is to provide an improved construction for preventing the shift of the sheath, which can prevent the shift of the sheath at the connecting portion between the metal shell and the net, and to prevent a lowering of the shielding performance and to improve the efficiency of the operation.

In order to solve the problems described above, according to the invention, there is provided a construction for preventing the shift of the sheath of a shield wire which includes an outer housing; an inner housing including a terminal receiving chamber for receiving a terminal, formed within the outer housing; a shell insertion groove formed between the outer housing and the inner housing; a metal shell inserted into the shell insertion groove, the metal shell rearwardly extended from the shell insertion groove; and, a contact element including a contact portion connected to the metal shell, a clamped portion connected on a shielding net folded back on the sheath after being exposed by removing an end portion of the sheath of the shield wire, and a folded portion formed to extend the clamped portion, the folded portion being folded to an inside of the clamped portion, and inserted between the shielding net and an inner insulator so that the sheath and the shielding net are nipped by the clamped portion and the folded portion.

The shielding net and the sheath are nipped by the clamped portion and the folded portion as the clamped portion of the contact element is clamped. As a result, a force for clamping is not absorbed by a deformation of an insulated core and the like, and acts as a force for nipping the shielding net and the sheath effectively. Therefore, the sheath and the contact element are firmly secured to prevent the shift of the sheath.

DETAILED DESCRIPTION OF THE PREFERRED EMBODIMENTS

With reference to the drawings, a construction for preventing a shift of a sheath according to the preferred embodiment of the invention will be described in detail hereinafter.

Figure 1:
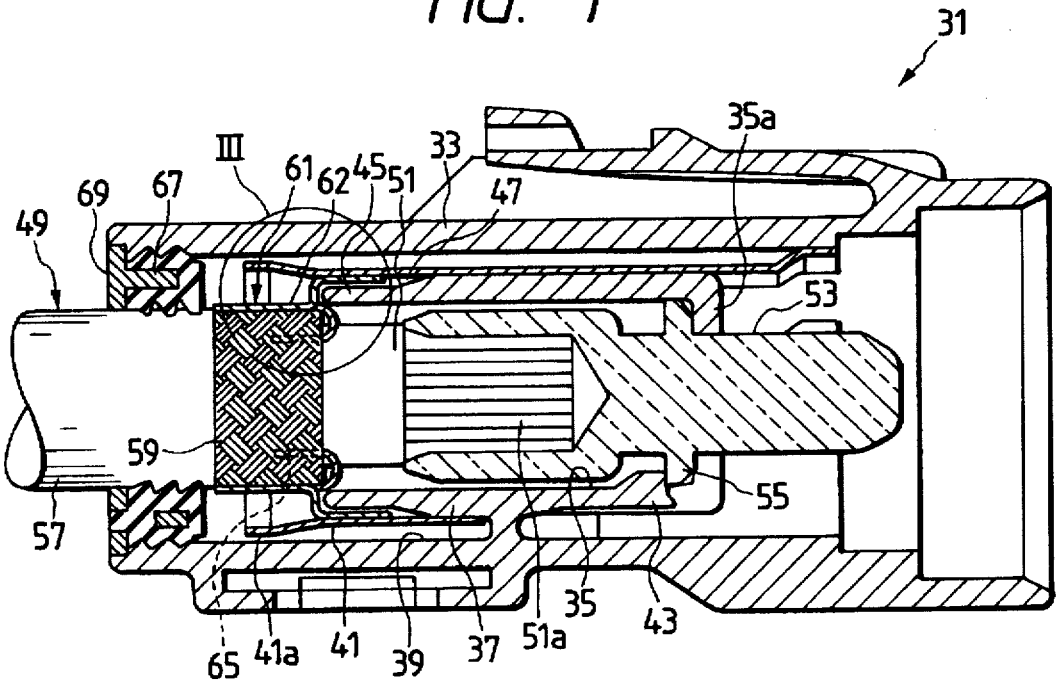
FIG. 1 is a cross-sectional view of a construction for preventing a shift of a sheath.
Figure 2:
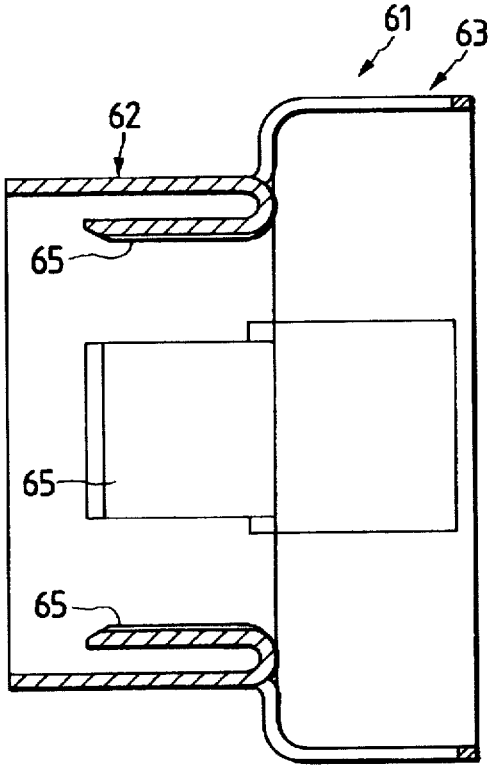
FIG. 2 is an enlarged view illustrating a contact element used for the construction for preventing the shift of the sheath of the invention.
Figure 3:
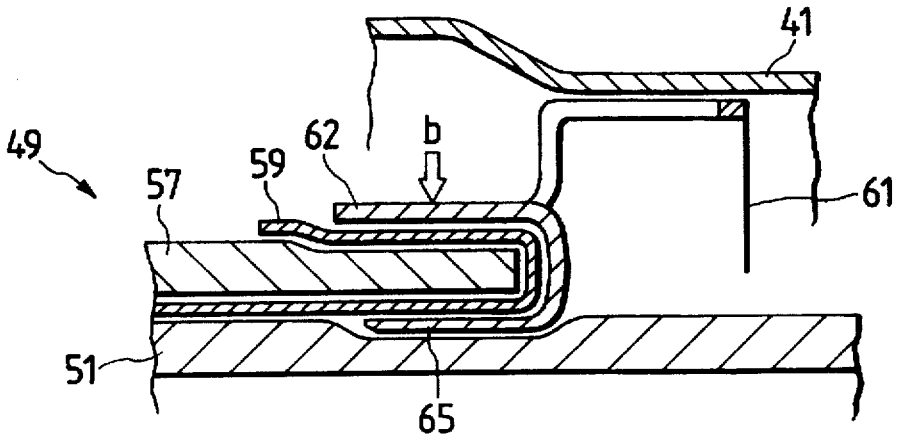
FIG. 3 is a partially enlarged view illustrating a portion III indicated in FIG. 1.

FIG. 1 is a cross-sectional view of a construction for preventing a shift of a sheath of the invention, FIG. 2 is an enlarged view illustrating a contact element used for the construction for preventing the shift of the sheath, FIG. 3 is a partially enlarged view illustrating a portion III indicated in FIG. 1.

A connector 31 includes a cylindrical outer housing 33 and a cylindrical inner housing 37 with a terminal receiving chamber 35 integrally formed within the outer housing 33. A shell insertion groove 39 is formed between the outer housing 33 and the inner housing 37. A metal cylindrical shell 41 is inserted into the shell insertion groove 39 so as to contact the outer circumferential surface of the inner housing 37. A large diameter portion 41*a* is formed on a rear portion of the metal shell 41 to extend from a rear end of the inner housing 37 to the outer housing 33.

An elastic terminal retaining piece 43 is formed in the terminal receiving chamber 35 of the inner housing 37, the terminal retaining piece 43 is engaged with a round terminal which is described hereinafter. A small diameter portion 45 is formed at the rear end of the inner housing 37, therefore, an insertion gap 47 is provided between the metal shell 41 and the small diameter portion 45.

On the other hand, a terminal 53 is press-fitted to a conductor 51*a* of an insulated core 51 of a shield wire 49. The terminal 53 has a flange portion 55 which engages the terminal retaining piece 43 of the terminal receiving chamber 35. When the terminal 53 is inserted into the terminal receiving chamber 35, the flange portion 55 is abutted against a front wall 35*a* of the terminal receiving chamber 35, at the same time, a rear surface of the flange portion 55 is engaged by the terminal retaining piece 43. That is, the flange portion 55 is held by the front wall 35*a* and the terminal retaining piece 43 to prevent the withdrawal of the terminal 53 while a rotation of the terminal 53 is allowed.

An end portion of a sheath 57 of the shield wire 49 is removed to expose an end portion of a net 59. The end portion of a net 59 is folded back on the sheath 57. A cylindrical contact element 61 is positioned over the folded portion of the net 59. As shown in FIG. 2, a clamped portion 62 in a small diameter is formed on one end of the contact element 61 to connect the net 59 by clamping after the clamped portion 62 is put over the net 59. A contact portion 63 in a large diameter is formed on the other end of the contact element 61. The contact portion 63 is inserted into the insertion gap 47, thereby an outer circumferential surface of the contact portion 63 intimately contacts the inner circumferential surface of the metal shell 41. The contact element 61 has a plurality of folded portion 65 (in this embodiment, four folded portions), which can be provided. For example, the folded portions 65 are formed by cutting a part of the contact portion 63 and folding to an inside of the clamped portion 62.

A rubber plug 67 is attached on the shield wire 49 at a position rearwardly of the outer housing 33 for preventing water and dust from entering. The rubber plug 67 is held within the outer housing 33 by a rear holder 69.

In order to assemble the construction for preventing the shift of the sheath, as shown in FIG. 3, the sheath 57 at the end of the shield wire 49 is removed, the exposed end portion of the net 59 is folded back on the sheath 57, and the clamped portion 62 of the contact element 61 is attached to the net 59 folded back on the sheath 57. At this time, the folded portion 65 is inserted between the net 59 and the insulated core (inner insulator) 51. That is, the portion of the net 59 folded back on the sheath 57 is nipped by the clamped portion 62 and the folded portion 65. Under this condition, the net 59 and the sheath 57 are press-fitted between the clamped portion 62 and the folded portion 65 by clamping the clamped portion 62 in the direction of arrow b (see FIG. 3).

Sequentially, the terminal 53 connected to the shield wire 49 by clamping is inserted into the housing with the metal shell 41 inserted into the insertion groove 39, at the same time, the flange portion 55 of the terminal 53 is engaged with the terminal retaining piece 43.

Finally, the rubber plug 67 is attached to a predetermined position in the outer housing 33, further, the rear holder 69 for holding the rubber plug 67 is mounted. Thus, the assembly is completed.

In the arrangement, thus assembled, for preventing the shift of the sheath, once the clamped portion 62 of the contact element 61 are clamped, the net 59 and the sheath 57 are nipped by the clamped portion 62 and the folded portion 65, and the force for clamping is not absorbed by a deformation of the inner insulator and like, and acts as a force for nipping the net 59 and the sheath 57 effectively. Therefore, the sheath 57 and contact element 61 are firmly secured to prevent the shift of the sheath 57.

As described above, according to the construction for preventing the shift of the sheath, the shift of the sheath does not occur because the sheath 57 is firmly nipped by the clamped portion 62 and the folded portion 65 so that the folded portion 65 is formed to extend the clamped portion 62 of the contact element 61, and the clamped portion 62 is clamped after inserting the folded portion 65 between the net 59 and the inner insulator 51. As a result, an insufficient contact between the metal shell 41 and net 59 is avoided and the decrease of the shielding performance is prevented. Further, an adhesive for preventing the shift of the sheath is no longer necessary since the clamped portion is strengthened, which can simplify the assembling work of the wire.

Figure 4:
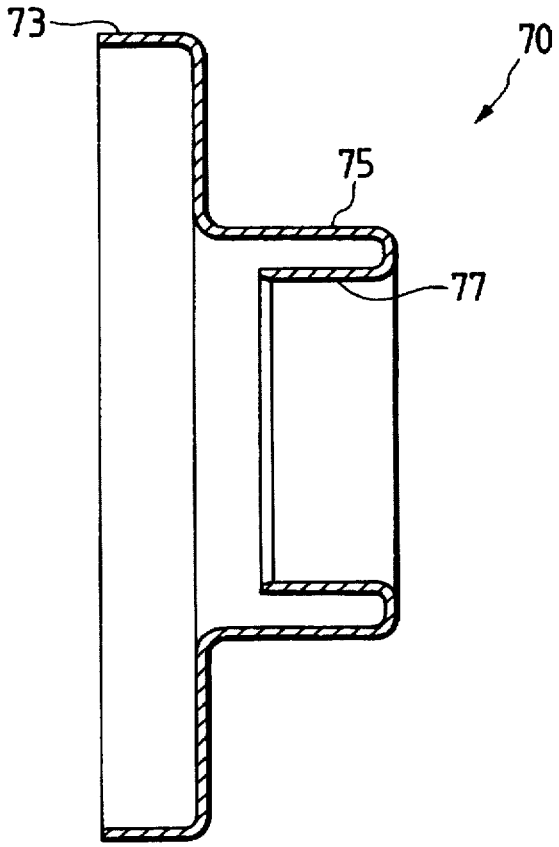
FIG. 4 is a cross-sectional view of a contact element used for a construction for preventing a shift of a sheath according to another embodiment of the invention.
Figure 5:
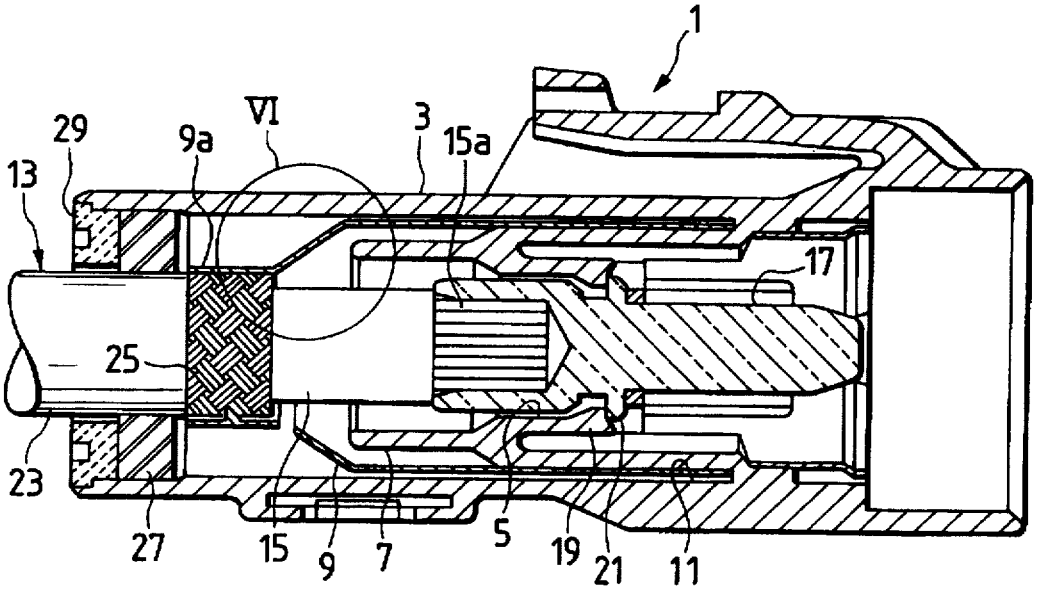
FIG. 5 is a cross-sectional view illustrating the connection between the metal shell and the net of the conventional example.
Figure 6:
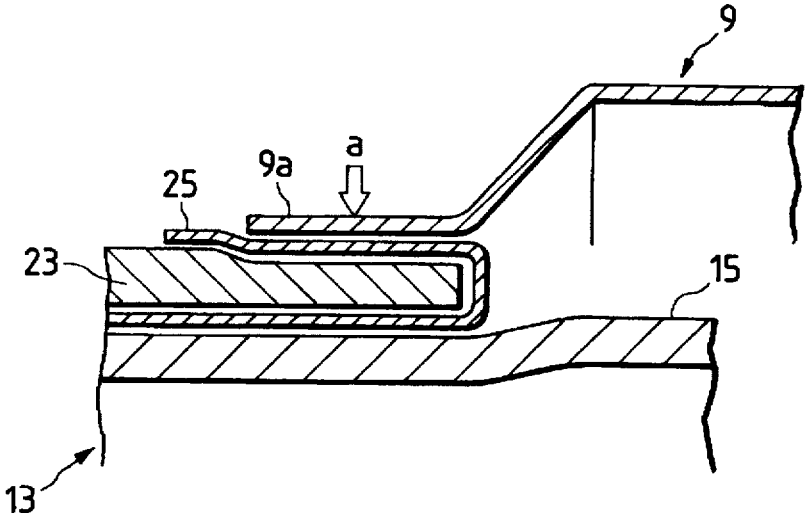
FIG. 6 is an enlarged view illustrating a portion VI indicated in FIG. 5.

Another embodiment of a contact element used for an arrangement for preventing the shift of the sheath according to the invention will be described. FIG. 4 is a cross-sectional view of a contact element used for a construction for preventing the shift of the sheath according to another embodiment.

In this embodiment, at one end of a cylindrical contact element 70, a contact portion 73 in a large diameter is formed to intimately contact the inner circumferential surface of the large diameter portion 41*a* of the metal shell 41. A clamped portion 75 in a small diameter is formed on the other end of the contact element 70, and a folded portion 77 is formed by folding an end portion of the clamped portion 75 into the inside of the clamped portion 75 in cylindrical.

In order to assemble the contact element 70, the sheath 57 on the end of the shield wire 49 is removed (refer to FIG. 3), the exposed end portion of the net 59 is folded over the sheath 57, and then the contact element 70 is inserted from a side of the contact portion 73 into the shield wire 49, and the folded portion 77 is inserted between the net and the inner insulator. Thus, the portion of the net 59, which is folded back on the sheath 57 so as to nip the sheath, is further nipped from the outside by the clamped portion 75 and the folded portion 77. Under this state, the net 59 and the sheath 57 is press-fitted between the clamped portion 75 and the folded portion 77 by clamping the clamped portion 75.

As the contact element 61 described above, in the contact element 70, the sheath 57 is nipped by the clamped portion 75 and the folded portion 77 as the clamped portion 75 is clamped. Therefore, it is possible to ensure a strength of the folded portion 77 largely and strengthen the nipping force between the clamped portion 75 and the folded portion 77, because not only the force for clamping the clamped portion 75 is not absorbed by a deformation of the inner insulator 51 and the like, but also the folded portion 77 is folded as it is in the cylindrical shape.

In the embodiment described above, although the contact element 61 and the metal shell 41 are provided separately, the clamped portion 62 or 75 and the folded portion 65 or 77 may be integrally formed with the metal shell 41.

It is further understood by those skilled in the art that the foregoing description is a preferred embodiment of the disclosed device and that various changes and modifications may be made without departing from the spirit and scope of the invention.

What is claimed is:

1. A construction for preventing a shift of sheath of a shield wire, said construction comprising:

an outer housing;

an inner housing including a terminal receiving chamber for receiving a terminal, formed within said outer housing;

a shell insertion groove formed between said outer housing and said inner housing;

a metal shell inserted into said shell insertion groove, said metal shell rearwardly extended from said shell insertion groove; and a contact element, including:

a contact portion connected to said metal shell;

a clamped portion connected on a shielding net folded back on the sheath after being exposed by removing an end portion of the sheath of the shield wire; and a folded portion connected to said clamped portion, said folded portion being folded to an inside of said clamped portion, and inserted between the shielding net and an inner insulator so that the sheath and the shielding net are nipped by said clamped portion and said folded portion.

2. The construction of claim 1, wherein said folded portion is formed by cutting a part of said contact portion.

3. The construction of claim 1, wherein said contact element has a cylindrical shape.

4. The construction of claim 1, wherein said contact element has a cylindrical shape, and wherein said folded portion is formed by folding an end portion of said clamped portion in cylindrical shape.

5. The construction of claim 1, further comprising a insertion gap formed between said inner housing and said metal shell inserted into said shell insertion groove, wherein said contact element is contacted said metal shell by inserting said contact portion of said contact element into said insertion gap.

6. The construction of claim 1, wherein said contact element is press-fitted to the shield wire by clamping said clamped portion.

7. A contact element, comprising:

a clamped portion connected on a shielding net folded back on a sheath after being exposed by removing an end portion of the sheath of a shield wire; and a folded portion connected to said clamped portion, said folded portion being folded to an inside of said clamped portion, and inserted between the shielding net and an inner insulator so that the sheath and the shielding net are nipped by said clamped portion and said folded portion.

8. The contact element of claim 7, wherein said folded portion is formed by cutting a part of said contact element.

9. The contact element of claim 7, wherein said contact element has a cylindrical shape.

10. The contact element of claim 7, wherein said contact element has a cylindrical shape, and wherein said folded portion is formed by folding an end portion of said clamped portion in cylindrical shape.

11. The contact element of claim 7, wherein said contact element is press-fitted to the shield wire by clamping said clamped portion.

* * * * *